US007410003B2

(12) United States Patent
Ravensbergen et al.

(10) Patent No.: US 7,410,003 B2
(45) Date of Patent: Aug. 12, 2008

(54) DUAL PURPOSE BLOW OUT PREVENTER

(75) Inventors: John Edward Ravensbergen, DeWinton (CA); Doug Brunskill, Calgary (CA)

(73) Assignee: BJ Services Company, Houston, TX (US)

( * ) Notice: Subject to any disclaimer, the term of this patent is extended or adjusted under 35 U.S.C. 154(b) by 73 days.

(21) Appl. No.: 11/602,511

(22) Filed: Nov. 20, 2006

(65) Prior Publication Data

US 2007/0137866 A1 Jun. 21, 2007

Related U.S. Application Data

(60) Provisional application No. 60/738,244, filed on Nov. 18, 2005.

(51) Int. Cl.
*E21B 19/22* (2006.01)
*E21B 33/06* (2006.01)

(52) U.S. Cl. ..... 166/384; 166/77.2; 166/85.4; 251/1.1

(58) Field of Classification Search ..... 166/384, 166/379, 385, 77.2, 85.4; 251/1.1, 1.2, 1.3
See application file for complete search history.

(56) References Cited

U.S. PATENT DOCUMENTS 4,940,095 A * 7/1990 Newman ..... 166/378
5,014,781 A * 5/1991 Smith ..... 166/66.5
6,321,846 B1 * 11/2001 Rytlewski ..... 166/363
6,834,721 B2 * 12/2004 Suro ..... 166/297
6,843,463 B1 * 1/2005 McWhorter et al. ..... 251/1.1
2003/0132004 A1 * 7/2003 Suro ..... 166/380
2004/0251022 A1 * 12/2004 Smith ..... 166/250.17
2005/0274527 A1 * 12/2005 Misselbrook et al. ..... 166/369

* cited by examiner

*Primary Examiner*—Hoang Dang
(74) *Attorney, Agent, or Firm*—Howrey LLP

(57) ABSTRACT

An improved dual purpose blow out preventer ("BOP") that provides both deployment and wellhead pressure containment functions. The dual purpose BOP may include four sets of rams including a set of seal/slip rams that provide bi-directional sealing being a first barrier to downhole pressure. The seal/slip rams may also grip a portion of a bottom hole assembly and create the bottom seal of an annular chamber. The BOP may include a set of seal rams that create the top seal of the annular chamber. The annular chamber may be pressurized through a port in the BOP, which may actuate a coiled tubing connector. The BOP may include a set of locate rams used to position a coiled tubing connector within the BOP stack. The BOP may also include a set of blind/shear rams that provide bi-directional sealing being a second barrier to wellhead pressure.

27 Claims, 10 Drawing Sheets

DUAL PURPOSE BLOW OUT PREVENTER

This application is a Non-provisional application claiming priority to U.S. Provisional Application Ser. No. 60/738,244 entitled, "Dual Purpose Blow Out Preventor," by John Edward Ravensbergen, filed Nov. 18, 2005, hereby incorporated by reference in its entirety herein.

BACKGROUND OF THE INVENTION

1. Field of the Invention

The present invention relates generally to a dual purpose blow out preventer ("BOP"). Specifically, the BOP combines the functions of a deployment BOP with a typical wellhead pressure containment BOP. The invention is particularly useful in oil and gas well applications using a coiled tubing ("CT") string connected to a bottom hole assembly ("BHA") using a universal connect/disconnect ("UCD"). The invention may also be used in applications where mechanically actuated connectors are used to connect a BHA to a CT string.

2. Description of the Related Art

U.S. Pat. No. 6,209,652 ("the '652 patent"), incorporated herein in its entirety, discloses a deployment BOP for running tools into a well. The deployment BOP may be a 7 1/16 10,000 PSI BOP commercially offered by Vanoil Equipment Inc. of Leduc, Alberta, Canada. The deployment BOP provides at least two rams having sealing surfaces with a chamber defined between the sealing surfaces of the rams. The chamber has a port for communicating fluid to pressurize the chamber. A vertical position element is attached to the deployment BOP and a slip is also attached to the deployment BOP. Preferably, the vertical positioning element and the slip are associated with rams located within the BOP. A gate valve may be attached to the top of the deployment BOP and a wellhead pressure containment BOP attached to the bottom of the deployment BOP. A riser, either wireline or coiled tubing, is typically attached to the top of the gate valve depending on the desired operation. In a preferred embodiment, the deployment BOP has three rams with the lower ram having a slip and a sealing surface located above the slip. The middle ram also includes a sealing surface. The upper ram includes the vertical positioning element and the horizontal position adjusting element.

The '652 patent also includes a method for deploying tools in a live well comprising the steps of externally pressuring at least a portion of a first section of a connector tool in a pressure chamber at the surface of the well, the step of mating a second section of the connector tool with the first section longitudinally and the step of releasing the external pressure. The external pressuring step overcomes a force biasing a latch element of the first section. The pressure releasing step causes the latch element to longitudinally latch the second section with the first section. The method preferably includes rotationally aligning the first and second sections after longitudinally mating the sections.

Prior to the '652 patent, deployment systems often required rotational alignment of the connector tool sections before or during the connection of the sections. Rotational alignment of a CT string is not easy as neither half of the connector can be easily rotated. Further, the need for rotational alignment slowed down the process and required personnel around the riser during the process, a situation to be minimized in sour well operations. To solve this problem, the '652 patent discloses a novel UCD that is initially left free to rotate during the vertical connection and a rotational lock is triggered subsequently when the tool first experiences a rotational force. The system of the '652 patent uses pressure activation for implementing the release mechanism of the UCD. The system uses a piston designed to move at a predetermined pressure, affording release of the connector sections, thus providing for "hands-free" deployment.

The '652 patent discloses the method of making up a tool lowered within a BOP stack as follows. The lowest modular tool portion, having a lower section of a UCD affixed to its top, is made up with the upper section of a UCD connected to a wireline. The modular tool, and wireline are then pulled into the wireline riser and the wireline riser is raised and installed over the gate valve. The gate valve is opened and the modular tool section is lowered via the wireline through the deployment apparatus and coiled tubing BOP.

The tool is lowered below the upper vertical locating ram of the deployment BOP and the upper vertical locating ram is closed. The tool is then pulled up until a shoulder of the lower UCD section attached to the tool rests against a shoulder of the vertically locating deployment ram. The lower sealing slip ram and upper sealing ram are then closed about the lower UCD section. The closure of the lower sealing slip ram and upper sealing ram creates a sealed annular chamber around the UCD. The slip ram also supports the weight of the tool and pressure induced forces on the tool.

Fluid is applied to an annular chamber through a valve creating pressure in the chamber. The vertical connection between the lower UCD section attached to the tool module and the upper UCD section attached to the wireline is broken by means of the pressure. The wireline with its attached upper UCD section is raised into the wireline riser. The gate valve on top of the deployment BOP is closed.

The wireline riser is disconnected from the gate valve and returned to pick up a second tool module. Once a second tool module is loaded into the wireline riser, it is again reinstalled on top of the gate valve. This time the riser contains the wireline with its attached upper UCD section mated to a lower UCD section attached to the top of the second modular tool unit of the BHA. The second modular BHA unit is attached, as discussed above, at its bottom to an upper UCD section. Upon mating of the riser with the gate valve, the gate valve is opened and the second modular tool unit is lowered. The second unit with its upper UCD section attached to its bottom portion is lowered to rest upon a shoulder of the lower UCD section attached to the upper portion of the initial tool module, the lower section being held in the slip and sealing rams.

When the upper and lower UCD sections are vertically aligned and mated, the pressure is bled off in the annular chamber. When the pressure is released the UCD mechanisms lock together the upper and lower UCD sections. The union is, at this point, independent of the angular rotation of either UCD section, since the detent of the bottom section is circular. The deployment apparatus rams are now released and the first and second tool modules are lowered such that the lower UCD section attached to the top of the second tool module is in the deployment apparatus. The vertical locating ram is closed, and the lower tool section is pulled upwardly until its vertical height is adjusted. The sealing and slip rams are now closed around portions of the lower UCD section. Pressure is applied, as above, to disconnect the upper UCD section connected to the wireline from the lower UCD section affixed to the top of the tool string. The wireline and upper UCD section are pulled into the wireline riser, and the gate valve is shut.

The wireline riser is unmated from the gate valve and returned to the ground to pick up a third tool module, it also having a lower UCD section affixed to its top and an upper UCD section affixed to its bottom. The procedure is continued until the time comes to connect the upper tool module to the coiled tubing. At this point the coiled tubing riser, usually only a few feet long, is deployed in place of the wireline riser. The procedure to affix the last tool module to the coiled tubing head is similar to the above, the bottom end of the coiled tubing being connected to an upper UCD section. The coiled tubing riser will remain mated with the gate valve during tool operation downhole.

The deployment BOP disclosed in the '652 patent is very useful in the insertion of tools and a CT string into a well. However, as the '652 patent recognizes, such a "deployment BOP" does not perform a standard BOP function and is actually expected to be used in combination with a wellhead pressure containment BOP. One reason that a wellhead pressure containment BOP must be used in conjunction with the deployment BOP is the different functions of the rams in each BOP. Specifically, the rams in the deployment BOP are for the deployment of tool segments whereas the rams in a wellhead pressure containment BOP provide barriers to wellhead fluids at pressure. However, a wellhead pressure containment BOP and a deployment BOP both have slip and seal functions, but the rams in the deployment BOP typically seal on a BHA or UCD while the rams in a wellhead pressure containment BOP typically seal on the CT string. Usually the outer diameter of the BHA and UCD are larger than the outer diameter of typical CT strings. Thus, the different functions of the rams as well as the different outer diameters necessitate the use of two separate BOPs.

The use of a deployment BOP and a wellhead pressure containment BOP increases the overall height of the BOP stack. The increased height of the BOP stack increases the safety risk to those providing service and maintenance on the BOP stack. Further, the use of both a deployment BOP and a wellhead pressure containment BOP increases the capital and maintenance costs. The increased number of hydraulic rams also requires more accumulators and hydraulic circuits requiring more auxiliary equipment to run the BOP stack. Overall, the use of a deployment BOP in addition to a wellhead pressure containment BOP increases the costs expended on the operation.

However as noted above, a deployment BOP can be very useful in making up and breaking apart downhole tools. The purpose of the deployment BOP is to simplify the rig up and surface equipment when running long BHAs into a live well. Without a deployment system the entire BHA length must be accommodated in the CT riser. Therefore, the CT riser needs to be longer than the BHA's overall length. Because of the length of the CT riser, the injector must be located very high off the ground requiring a very large crane. Large cranes are expensive and working with heavy suspended loads is slow and less safe than handling smaller lighter loads. The deployment BOP permits running the tool into the live well in modules. Thus, the injector does not have to be as high of the ground. In addition, a wireline riser can be used to place the modules into the well. A wireline riser is much lighter than a CT riser and injector assembly, and even a long wireline riser can be managed with a relatively small crane. Further, it is often difficult to connect a CT string to a BHA located in the wellhead. This is due to the residual curvature of the CT string as it exits the CT injector into the BOP. As the CT string exits the injector the angle of the CT string may continue to change causing the end of the string to move to different radial locations within the BOP bore.

A BOP that functions as both a deployment BOP and as a wellhead pressure containment BOP may minimize the overall height of the BOP stack. Further, such a dual purpose BOP may allow the use of BHA modules such that a wireline riser may be used to run the BHA rules into the BOP. However, a BOP that performs these two functions may require bi-directional sealing rams. U.S. Pat. No. 6,877,712 to Wiedemann ("the '712 patent"), incorporated herein in its entirety, discloses a BOP having a set of rams that may seal bi-directionally.

The disclosed rams include an upper sealing surface, a lower sealing surface, an upper sealing element, an intermediate sealing element, and a lower sealing element. When the rams are containing pressure from below the upper sealing elements and the intermediate sealing elements contain the pressure. Likewise, when the rams are containing pressure from above the lower sealing elements and the intermediate sealing elements contain the pressure.

The '712 patent also discloses a first pressure diversion port and a second pressure diversion port. When the rams are in a closed pressure containment position the first pressure diversion port may divert pressure from below the set of rams to a chamber behind the rams. The second pressure diversion port may be used to divert pressure from above the set of rams to a chamber behind the rams. The diverted pressure may help to maintain the rams in a sealing position whether the pressure is diverted from above or below the rams. The '712 patent further discloses that a first valve may be used to selectively open or close the first diversion port and a second valve may be used to selectively open or close the second diversion port. The operation of such valves may be dangerous due to the high pressures often contained by a wellhead pressure containment BOP.

In light of the foregoing, it would be desirable to provide a BOP that minimizes the overall height of the BOP stack. Further, it would be desirable to provide a single BOP that functions as both a deployment BOP as well as a wellhead pressure containment BOP. It would also be desirable to provide a BOP that provides for the proper alignment of a CT string to be connect to a BHA. It would be desirable to reduce the number of rams used in a BOP stack by using rams that have both wellhead pressure containment and deployment functions. It would be desirable to design a BHA that can be deployed with the rams suitable for a CT string. Additionally, it would be desirable to remove the gate valve to further reduce the stack height and include its function into the BOP.

It would also be desirable to provide a bi-directional sealing set of rams that may be used in a dual purpose BOP. It would further be desirable to provide a valve that may be remotely actuated to allow pressure from above or below the set of rams to enter into a chamber behind the rams, the pressure helping maintain the set of rams in a sealing position. The remote actuation of the valve may minimize or eliminate the need to have personnel in the vicinity of the BOP. It may also be desirable to configure the pressure valves such that the valves failsafe to the wellhead pressure containment function.

The present invention is directed to overcoming, or at least reducing the effects of, one or more of the issues set forth above.

SUMMARY OF THE INVENTION

The present application discloses a BOP that functions as both a deployment BOP and a wellhead pressure containment BOP. In one embodiment, this is achieved by a BOP having four sets of rams. The four sets of rams from the top down may be a set of blind/shear rams, a set of locate rams, a set of pipe rams (also referred to herein as seal rams), and a set of pipe/slip rams (also referred to herein as slip/seal rams). The closure of the pipe rams and pipe/slip rams against a BHA may create an annular chamber between the two sets of rams. Alternatively, the BOP may have three sets of rams wherein one of the sets of rams may be used to create an annular chamber in conjunction with a stuffing box on a CT lubricator or a grease injection pack-off on a wire-line riser.

In a different embodiment, the BOP may include three sets of rams, a set of blind/shear rams, a set of pipe rams, and a set of pipe/slip rams. A BHA may be pulled up against an apparatus connected above the BOP, such as a stuffing box or a CT lubricator, to locate a connector within the BOP. For example, the BHA may be sized such that the connector is located between the set of pipe rams and the set of pipe/slip rams when the BHA is pulled up to the apparatus. Alternatively, after being pulled against an apparatus above the BOP, the BHA may be moved down a designated distance to locate the connector between the set of pipe rams and the set of pipe/slip rams. The closure of the pipe rams and pipe/slip rams against a BHA may create an annular chamber around the connector. The annular chamber may then be pressurized through a port to secure the connector to or disengage the connector with and adjacent connector.

In an alternative embodiment, the BOP may include three sets of rams, a set of blind/shear rams, a set of locate rams, and a set of slip/seal rams. The locate rams may be adapted to locate a BHA connector between the stuffing box and the set of slip/seal rams. The closure of the slip/seal rams against the BHA may create a large annular chamber around the BHA and the BHA connector between the stuffing box and the set of slip/seal rams. The annular chamber may then be pressurized through a port to secure the connector to or disengage the connector from an adjacent connector.

In another embodiment, the BOP may include three sets of rams, a set of blind/shear rams, a set of locate rams, and a set of slip/seal rams. The set of slip/seal rams may be adapted to close on a BHA connector and create an annular chamber around the connector. The set of slip/seal rams may include an upper sealing element and a lower sealing element which seal on the BHA connector to form the annular chamber. The slip/seal rams may include a fluid passageway in communication with the annular chamber, the fluid passageway allowing the annular chamber to be pressurized to secure the connector to or disengage the connector from an adjacent connector. A two-way valve connected to the fluid passageway may be used to control the pressurization and de-pressurization of the annular chamber.

In another embodiment, the BOP may include two sets of rams, a set of blind/shear rams and a set of slip/seal rams. A BHA may be pulled up against an apparatus connected above the BOP, such as a stuffing box or a CT lubricator, to locate a connector within the BOP. The set of slip/seal rams may be adapted to close on a BHA connector and create an annular chamber around the connector. The set of slip/seal rams may include an upper sealing element and a lower sealing element which seal on the BHA connector to form the annular chamber. The slip/seal rams may include a fluid passageway in communication with the annular chamber, the fluid passageway allowing the annular chamber to be pressurized to secure the connector to or disengage the connector from an adjacent connector. A two-way valve connected to the fluid passageway may be used to control the pressurization and de-pressurization of the annular chamber.

In one embodiment, the dual purpose BOP may include a first passageway located above the set of blind/shear rams that is in communication with a first valve, the first valve being a two-way valve. The first valve may be used to selectively allow pressure from above the blind/shear rams, when actuated, into a chamber located behind the blind/shear rams. The pressure within the chamber may assist the hydraulics to maintain the blind/shear rams in the actuated position sealing off against the pressure from above the blind/shear rams. The first valve may be configured to default to a closed positioned preventing pressure into the chamber behind the blind/shear rams. Hydraulic pressure may be applied to open the valve allowing pressure to enter into the chamber. In the event the valve fails, it may be configured to prevent pressure from entering into the chamber.

The BOP may include a second passageway located below the blind/shear rams that is in communication with a second valve, the second valve being a two-way valve. The second valve may be used to selectively allow pressure from below the blind/shear rams, when actuated, into a chamber located behind the blind/shear rams. The pressure within the chamber may assist the hydraulics to maintain the blind/shear rams in the actuated position sealing off against the pressure from below the blind/shear rams. The second valve may be configured to default to an open position allowing pressure into the chamber behind the blind/shear rams. Hydraulic pressure may be applied to close the valve preventing the entrance of pressure into the chamber. In the event the second valve fails, it is configured to failsafe allowing pressure from below the blind/shear ram into the chamber such that the downhole pressure is contained by the blind/shear rams.

The embodiment may include means to remotely actuate the two-way valves disclosed herein. For example, the two-way valves may be actuated hydraulically, pneumatically, or by other means as would be appreciated by one of ordinary skill in the art having the benefit of this disclosure. The hydraulic lines used to actuate the valves may further include a gauge that may be used to determine the activation pressure on each two-way valve. Further, each hydraulic line may include a lock that may be used to lock the hydraulic line opened or closed.

The dual purpose BOP may include a third passageway located above the set of pipe/slip rams that is in communication with a third valve, the third valve being a two-way valve. The third valve may be used to selectively allow pressure from above the pipe/slip rams, when actuated, into a chamber located behind the pipe/slip rams. The pressure within the chamber may assist the hydraulics to maintain the pipe/slip rams in the actuated position sealing off against the pressure from above the pipe/slip rams. The third valve may be configured to default to a closed position preventing pressure into the chamber behind the pipe/slip rams. Hydraulic pressure may be applied to open the valve allowing pressure to enter into the chamber. In the event the valve fails, it may be configure to prevent pressure from entering into the chamber.

The BOP may include a fourth passageway located below the pipe/slip rams that is in communication with a fourth valve, the fourth valve being a two-way valve. The fourth valve may be used to selectively allow pressure from below the pipe/slip rams, when actuated, into a chamber located behind the pipe/slip rams. The pressure within the chamber may assist the hydraulics to maintain the pipe/slip rams in the actuated position sealing off against the pressure from below the pipe/slip rams. The fourth valve may be configured to default to an open position allowing pressure into the chamber behind the pipe/slip rams. Hydraulic pressure may be applied to close the valve preventing the entrance of pressure into the chamber. In the event the fourth valve fails, it is configured to failsafe allowing pressure from below the pipe/slip rams into the chamber such that the downhole pressure is contained by the pipe/slip rams.

The BOP may include a fifth passageway located above the pipe rams that is in communication with a fifth valve, the fifth valve being a two-way valve. The fifth valve may be used to selectively equalize the pressure in the chamber behind the actuated pipe rams with the pressure present in the BOP above the pipe rams. The fifth valve is configured to default to a closed position preventing the equalization of pressure between the chamber behind the pipe rams and the BOP above the pipe rams. Hydraulic pressure may be applied to open the valve and allow the equalization of the pressure of the chamber with the BOP.

The BOP may include a port that may be used to pressurize or de-pressurize an annular chamber by the pumping or releasing of fluid. The annular chamber may be formed between the set of pipe rams and the set of pipe/slip rams closed around a BHA. The BOP may further include a port above the blind/shear rams. The port above the blind/shear rams may be used to pressure test various apparatus, such as a riser, attached to the BOP stack as would be appreciated by one of ordinary skill in the art having the benefit of this disclosure. The BOP may further include a port or valve between the blind/shear rams and the locate rams. This port may be used to equalize pressure within the BOP as would be appreciated by one of ordinary skill in the art having the benefit of this disclosure. The valves in the BOP may be remotely actuated eliminating the need for personnel in the immediate vicinity of the BOP.

The blind/shear rams of the dual purpose BOP may provide deployment as well as wellhead pressure containment functions. In deployment mode, the blind/shear rams may function as a gate valve that closes off the BOP. The blind/shear rams may be bi-directional thus, being able to seal off the BOP bore from pressure above, such as when an attached apparatus is being pressure tested and the blind/shear rams may be able to seal off downhole pressure from below. The use of a first passageway, a second passageway, a first valve, and a second valve as set forth above may enable the blind/shear rams to be bi-directional. In the wellhead pressure containment mode, the blind/shear rams may be able to cut through the CT string and the wireline in order drop the BHA into the well and seal off wellhead pressure in an emergency situation.

The locate rams of the BOP may provide deployment functions. The shape of the locate rams may be designed to function as a guide to connect mating halves of a UCD. A tool may be pulled up to the closed locate rams in order to position the UCD axially in the BOP stack. The closed locate rams may be adapted to provide a funnel shaped guide, which may be used to axially align and centralize a UCD attached to a CT string with residual curvature together with a downhole UCD. Preferably, the opening may allow for the upper portion of the UCD having an outer diameter of 3⅛ inches to pass through, but block the lower portion of the UCD having an outer diameter of 3⅜ inches. The size of the opening as well as the shape of the rams may be varied to accommodate various connections, tools, and strings as would be appreciated by one of ordinary skill in the art having the benefit of this disclosure. The locate rams may also be designed to properly locate a mechanically actuated connector of a BHA, such as the Coil Tubing C.A.R.S.A.C. HT connector offered by Pressure Control Engineering of Dorset, UK, so that a segment of a BHA may be added to or disconnected from a CT string.

The pipe rams, also known as seal rams, of the BOP may provide deployment functions. The pipe rams may be adapted to seal on the bottom half of the UCD creating the upper seal of an annular chamber. Preferably, the pipe rams may be designed to seal around the lower portion of the UCD having an outer diameter of 3⅜ inches. The pipe rams may be designed to seal around the portion of a mechanically actuated connector used to form a CT string. Alternatively, the set of rams may be adapted to secure or release a mechanically actuated connector used to connect a BHA to a CT string. The actual dimensions of the pipe rams may be varied as would be appreciated by one of ordinary skill in the art having the benefit of this disclosure.

The pipe/slip rams, also known as seal/slip rams, of the BOP may provide both deployment and wellhead pressure containment functions. The BHA may have been adapted to have a portion below the UCD having a smaller outer diameter than the rest of the BHA. The reduced diameter of the BHA portion may be substantially identical to the outer diameter of the CT string. Preferably, the pipe/slip rams seal on a portion of the BHA that has the same outer diameter as the outer diameter of the CT string, for example the portion of the BHA may be 1¾ inches in diameter. Again, the actual dimensions of the pipe/slip rams may be varied as would be appreciated by one of ordinary skill in the art having the benefit of this disclosure. When closed around the portion of the BHA, the pipe/slip rams may create the lower seal of an annular chamber.

The pipe/slip rams may require bi-directional sealing. The use of a third passageway, a fourth passageway, a third valve, and a fourth valve as set forth above may enable the pipe/slip rams to be bi-directional. When the pipe/slip rams are in a wellhead pressure containment function, they provide a barrier to wellhead pressure. The rams are required to seal against pressure from below. When the rams are used in a deployment function the rams must hold pressure from above.

The pipe/slip rams may also act as a slip holding the BHA in place within the BOP. In the instance the pipe/slip rams may fail to grip the BHA, the pipe/slip rams will retain the larger diameter sections whether the BHA slips down or is pushed up the BOP by downhole pressure. The pipe/slip rams may be adapted to accommodate BHAs having various dimensions as would be apparent to one of ordinary skill in the art having the benefit of this disclosure.

In one embodiment, each of the rams is hydraulically actuated. Alternatively, the rams may be actuated in other ways, such as pneumatically, as would be appreciated by one of ordinary skill in the art. The BOP may include hand wheels that may be used to lock down a set of actuated rams.

In one embodiment a hydraulic connector may be used to connect various oil well apparatus, such as a riser or lubricator, to the dual purpose BOP. The purpose of the hydraulic connector is to allow the CT riser or wireline riser to be attached to the BHA remotely. No personnel are required in the immediate vicinity of the BOP. This is especially beneficial if dangerous BHAs are being deployed such as perforating guns.

One embodiment of the present disclosure is the method for deploying a tool in a live well that may include inserting a tool into a dual purpose BOP stack, moving the tool past locate rams, closing the locate rams wherein the closed locate rams are adapted to have an opening, pulling the tool up to the closed locate rams, closing a set of pipe rams on the tool, closing a set of pipe/slip rams on the tool creating an annular chamber between the pipe rams and the pipe/slip rams, and pumping fluid into the annular chamber through a port on the BOP stack pressurizing the chamber. In one embodiment, the pressuring of the annular chamber may cause the release of an UCD connection as disclosed in the '652 patent discussed above. Additionally, releasing pressure from the annular chamber may cause the UCD connection to secure together. The method may further include allowing pressure from above the pipe/slip rams into a chamber located behind the pipe/slip rams. The method may further include equalizing the pressure within the annular chamber with the pressure above the closed set of pipe rams.

One embodiment of the present disclosure is BOP that functions as a wellhead pressure containment BOP as well as a deployment BOP for deploying a BHA using mechanically actuated connectors. In one embodiment, this is achieved by the BOP having four set of rams. The four sets of rams from the top down may be a set of blind/shear rams, a set of locate rams, a set of lock rams, and a set of pipe/slip rams. The blind/shear rams may function as a gate valve that closes off the BOP. The blind/shear rams may be bi-directional thus, being able to seal off the BOP bore from pressure above, such as when an attached apparatus is being pressure tested and the blind/shear rams may be able to seal off downhole pressure from below. In the wellhead pressure containment mode, the blind/shear rams may be able to cut through the CT string and the wireline in order drop the BHA into the well and seal off wellhead pressure in an emergency situation.

The set of locate rams may be used to position the mechanically actuated connector at a specified location within the BOP. Once in position, the lock rams may be closed to engage the connector preventing the rotation of a portion of the connector. A portion of the connector may then be rotated to engage another connector. Alternatively, the lock ram may be adapted to rotate a locking mechanism, such as a collar, to secure or disengage the connector.

The pipe/slip rams may provide a barrier to wellhead pressure. The pipe/slip rams may also provide bi-directional sealing. The pipe/slip rams may also act as a slip holding the BHA in place within the BOP. In the instance the pipe/slip rams may fail to grip the BHA, the pipe/slip rams may retain a larger diameter section of the BHA. The pipe/slip rams may be adapted to accommodate BHAs having various dimensions as would be apparent to one of ordinary skill in the art having the benefit of this disclosure.

Figure 1:
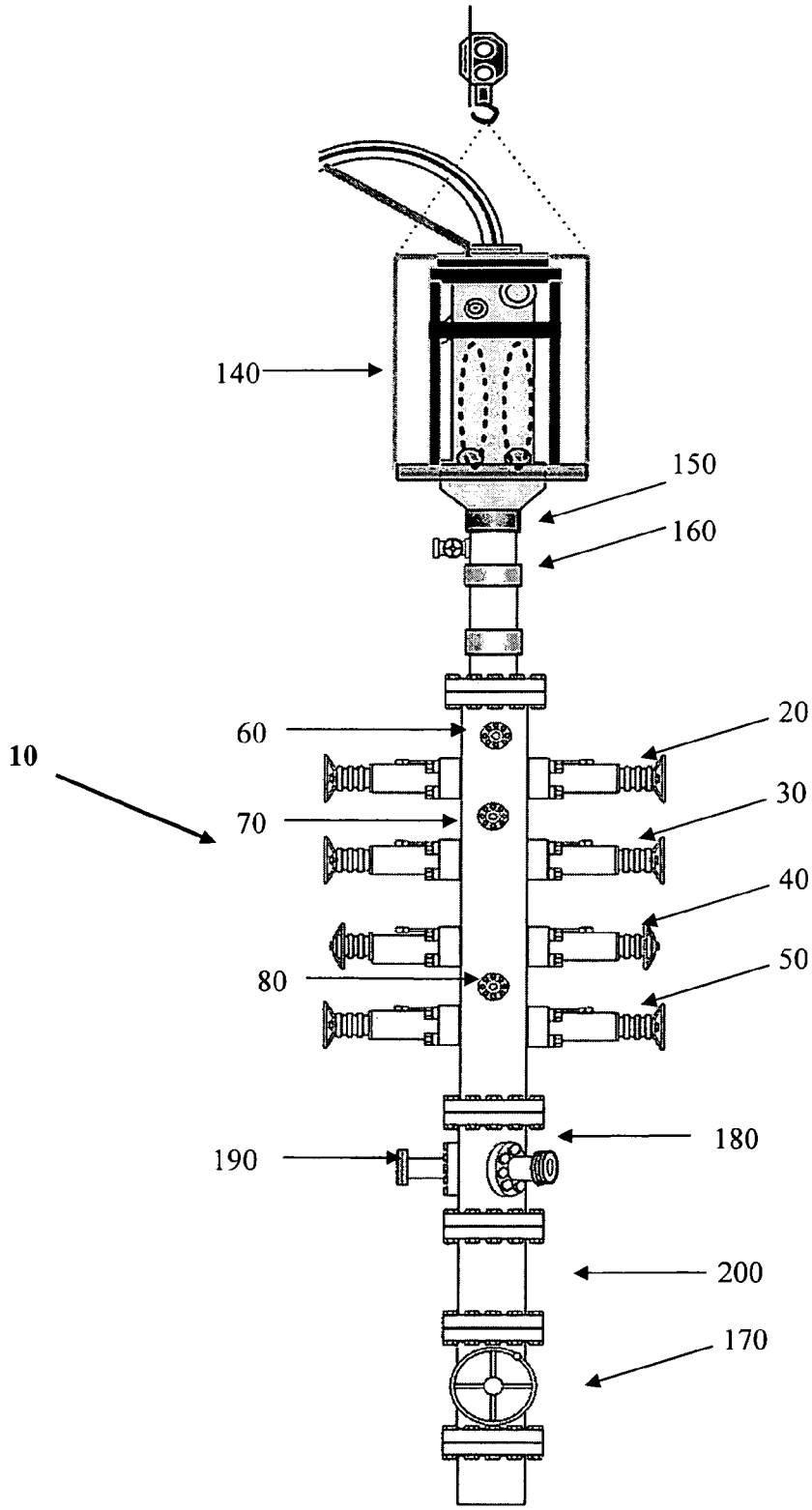
FIG. 1 shows a CT injector and CT riser connected above an embodiment of the dual purpose BOP of the present disclosure.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended

DESCRIPTION OF ILLUSTRATIVE EMBODIMENTS

Illustrative embodiments of the invention are described below as they might be employed in the use of designs for a dual purpose BOP or in the deployment of a tool into a dual purpose BOP. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

As shown in FIG. 1, the dual purpose BOP 10 may be used in conjunction with a CT injector 140. The dual purpose BOP 10 of FIG. 1 includes four sets of rams. From the top of the BOP down the rams are blind/shear rams 20, locate rams 30, pipe rams 40, and pipe/slip rams 50. In another embodiment, the pipe rams 40 may be adapted to actuate or disconnect a mechanically actuated connector used to connect a BHA to a CT string. The BOP 10 may include numerous ports that allow the transfer of fluid into and out of the BOP 10. The BOP 10 of FIG. 1 includes a port 60 above the set of blind/shear rams 20. The port 60 may be used in regards to the pressure testing of apparatus connected above the BOP 10.

The second set of rams is the locate rams 30. A port 70 may be located between the locate rams 30 and the blind/shear rams 20. This port 70 may be used to equalize the pressure of the BOP 10 when the blind/shear rams 20 are closed. The locate rams 30 are used to properly position a tool within the BOP 10. First, a tool is lowered below the locate rams 30 inside of the BOP 10. The locate rams 30 are then closed and the tool is pulled up to the locate rams 30. In order to allow for the tool to be pulled up, the locate rams 30 are designed to leave a specifically sized opening when the rams are closed. The locate rams 30 may be designed such that when closed the section view of the upper portion of the rams resembles a funnel that may aid in the proper alignment of the upper UCD section attached to a CT string to a lower UCD section. Further, the opening in the locate rams 30 may be sized to allow the upper portion of a UCD connection to fit through the opening, but not the lower portion of a UCD connection, the latter being too large to pass through. In a preferred embodiment, the upper UCD section has an outer diameter of 3⅛ inches whereas the lower UCD section has an outer diameter of 3⅜ inches. The opening size of the locate rams may be varied to accommodate various connections, tools, or strings as would be appreciated by one of ordinary skill in the art having the benefit of this disclosure. One of ordinary skill in the art will recognize that the opening in the locate rams 30 may also be sized to allow the upper portion of a mechanically actuated connector to fit through the opening, but not the lower portion of the mechanically actuated connector.

The pipe rams 40 shown in FIG. 1 may be adapted to seal on a portion of a lower UCD section. The pipe rams 40 close and seal on the lower UCD section creating the upper seal of an annular chamber. Preferably, the pipe rams 40 may be designed to seal around a 3⅜ inch lower UCD section, but the pipe rams 40 may be varied to seal against different downhole apparatus as would be appreciated by one of ordinary skill in the art having the benefit of this disclosure. Alternatively, the set of rams 40 may be adapted to actuate or disconnect a mechanically actuated connector used to connect a BHA to the CT string.

The pipe/slip rams 50 shown in FIG. 1 provide both deployment and wellhead pressure containment functions. Preferably, the pipe/slip rams 50 seal on a portion of the BHA that is 1¾ inch in diameter. When closed the pipe/slip rams 50 create the lower seal of an annular chamber. The pipe/slip rams 50 provide bi-directional sealing thus providing a seal of the annular chamber and may also act as a barrier to wellhead pressure. The pipe/slip rams 50 also act as a slip when closed on the BHA holding it in place.

Although FIG. 1 illustrates a dual purpose BOP 10 that may be used with a CT string that utilizes the UCD connectors as described above, the dual purpose BOP 10 of the present disclosure may be utilized with various known CT string connectors, such as the Coil Tubing C.A.R.S.A.C. HT connector offered by Pressure Control Engineering of Dorset, UK, as would be appreciated by one of ordinary skill in the art having the benefit of this disclosure. The disclosed BOP allows for a shorter overall stack height because a single BOP may be used on a wellhead for both deployment and pressure containment functions.

Once a mechanically actuated connector is located within the proper position within the BOP, one of the rams may be adapted to close and engage the connector such that the connected may not rotate within the BOP. A free portion of the connector may then be rotated to engage with another connector. Alternatively, the lock ram may be adapted to rotate a locking mechanism, such as a collar, to secure or disengage the connector.

Figure 5:
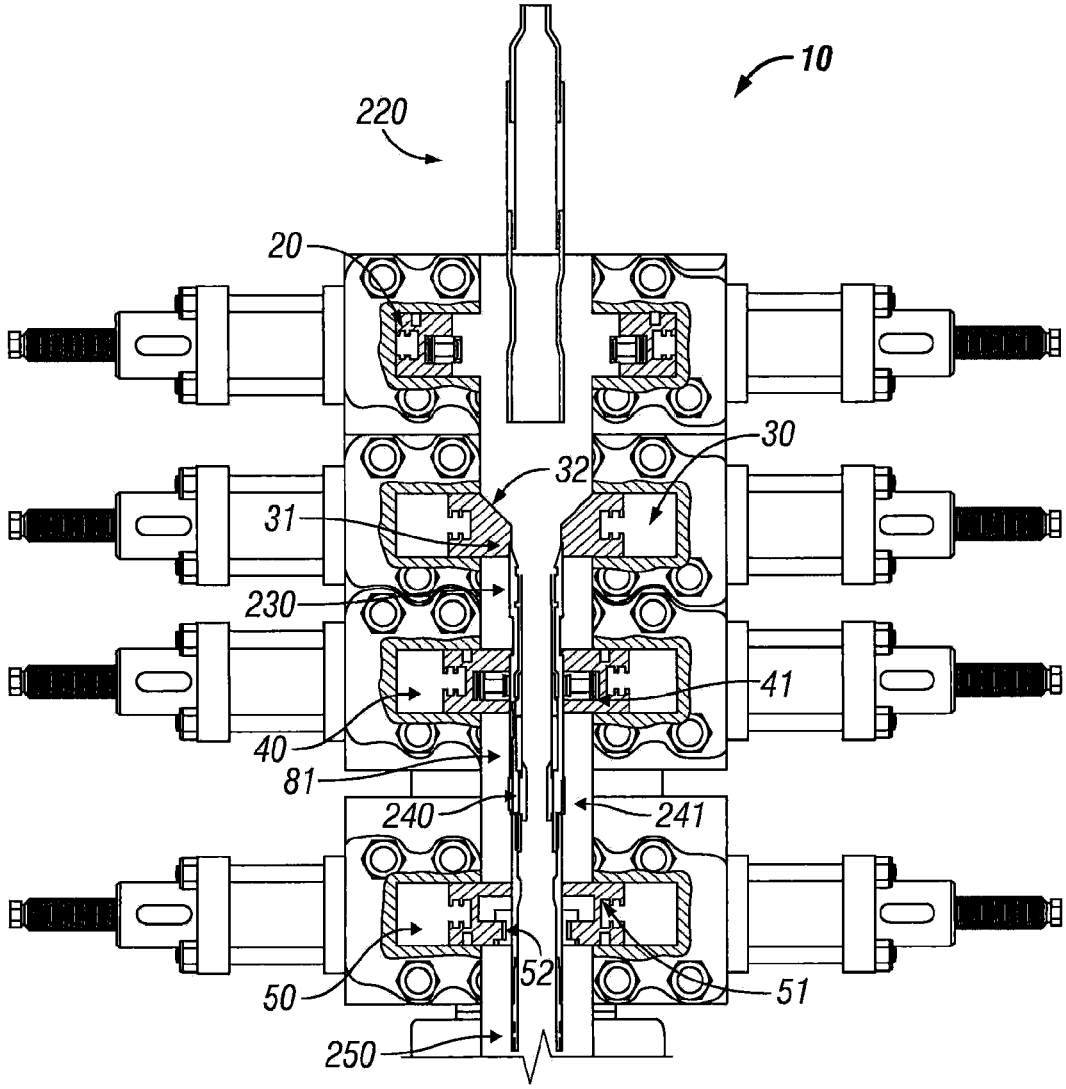
FIG. 5 is the cross-section of one embodiment of a dual purpose BOP of the present disclosure.

In an alternative embodiment, the dual purpose BOP 10 may only have three sets of rams as discussed below in reference for FIGS. 8-10. An annular chamber may be provided by the closure of one set of rams, which create the lower seal, in conjunction with the stuffing box 150 of the CT lubricator 160, which creates the upper seal. A port in the BOP 10 may be used to pressurize such a chamber. Alternatively, a grease injection pack-off on a wire-line riser may be used as an upper seal in conjunction with a set of rams as a lower seal to create an annular chamber. In another embodiment, one set of rams of the BOP may include two seals adapted to create an annular chamber between the seals as shown in FIGS. 5 and 10.

In one embodiment, the BHA may include a narrow section having a smaller diameter with sections having a larger diameter both above and below. In the preferred embodiment, a portion of the BHA adjacent to the UCD is adapted to have an outer diameter substantially identical to the outer diameter of the CT string. Thus, the identical ram can be used on this portion of the BHA as well as the CT string. In the instance that the pipe/slip rams 50 fail to grip the BHA completely, the pipe/slip rams 50 will retain the larger diameter sections of the remaining sections of the BHA whether the BHA begins to slip down the BOP 10 or is pushed up the BOP 10 by downhole pressure. As would be apparent to one of ordinary skill in the art having the benefit of this disclosure, the size of the pipe/slip rams may be adapted for various downhole applications.

The primary function of the annular chamber between the pipe rams 40 and the pipe/slip rams 50 is securing or releasing tool modules using a UCD. The UCD releases when an external pressure is exerted and the connection will become secure when the pressure is released as disclosed in the '652 patent. The BOP 10 of FIG. 1 includes a port 80 used to pressurize the annular chamber. As stated above, the locate rams 30 are used to position the tool within the BOP 10. This positioning locates the lower UCD section below the located rams 30 within the BOP 10. The pipe rams 40 and pipe/slip rams 50 are then closed creating the annular chamber, which is then pressurized through the port 80. The depressurization or the pressurization of the chamber allows for the build-up or break down of the tool as desired. As discussed above, the BOP 10 of the present disclosure may also be used to secure or release tool modules using various mechanically actuated connectors available in the oil and gas industry as would be appreciated by one of ordinary skill in the art.

As shown in FIG. 1, a CT injector 140 may be connected above the BOP 10. Between the CT injector 140 and the BOP 10, the BOP stack may include a stuffing box 150 and a lubricator 160. Below the BOP may be a flow spool 180 having fluid outlets 190 and/or a cross over spool 200 above the master valve 170. These elements (i.e., the CT injector 140, the stuffing box, etc.) are conventional oil well apparatus that are commercially available. A number of various elements, such as a wireline riser 130 as shown in FIG. 2, may be used in combination with the BOP 10 as would be appreciated by one of ordinary skill in the art having the benefit of this disclosure.

Figure 2:
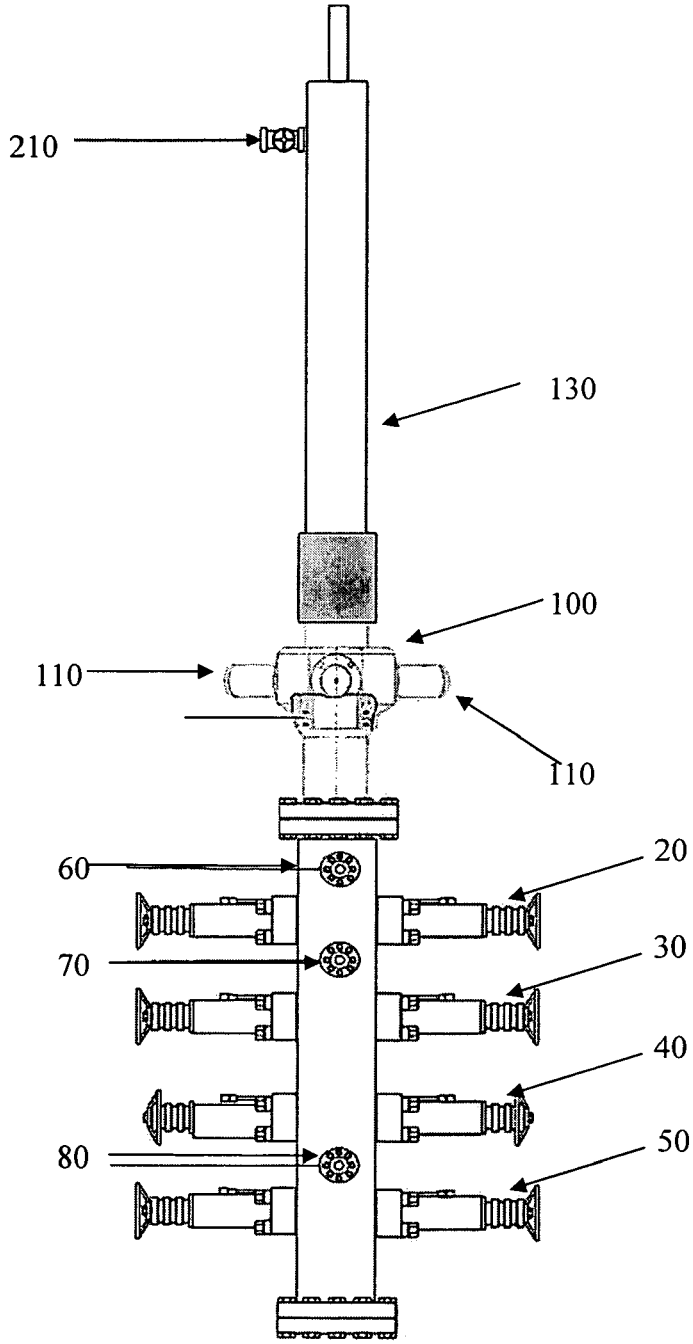
FIG. 2 shows a wireline riser connected above an embodiment of the dual purpose BOP of the present disclosure.

As shown in FIG. 2, the dual purpose BOP 10 may be used in conjunction with a riser 130. The riser 130 may be connected to the BOP 10 via a hydraulic connector 100. The hydraulic connector 100 may allow for the rapid connect or disconnect of the riser 130 to the BOP 10. Additionally, the hydraulic connector 100 may allow the connection or disconnection of a riser to be remotely operated. The BOP 10 may include a port 60 to be used in conjunction with the pressure testing of attachments such as the riser 130.

Figure 3:
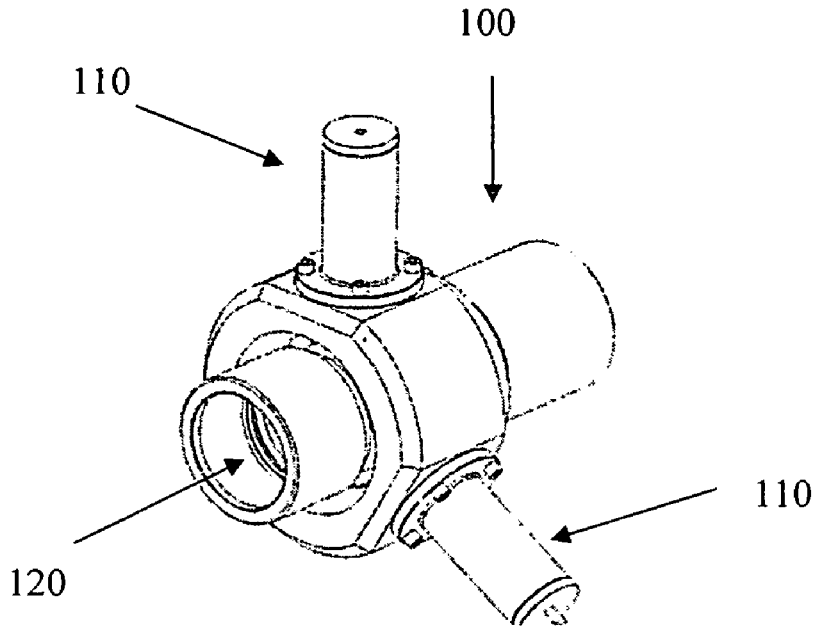
FIG. 3 is a perspective view of a hydraulic connector that may be used to connect various apparatus to a dual purpose BOP of the present disclosure.
Figure 4:
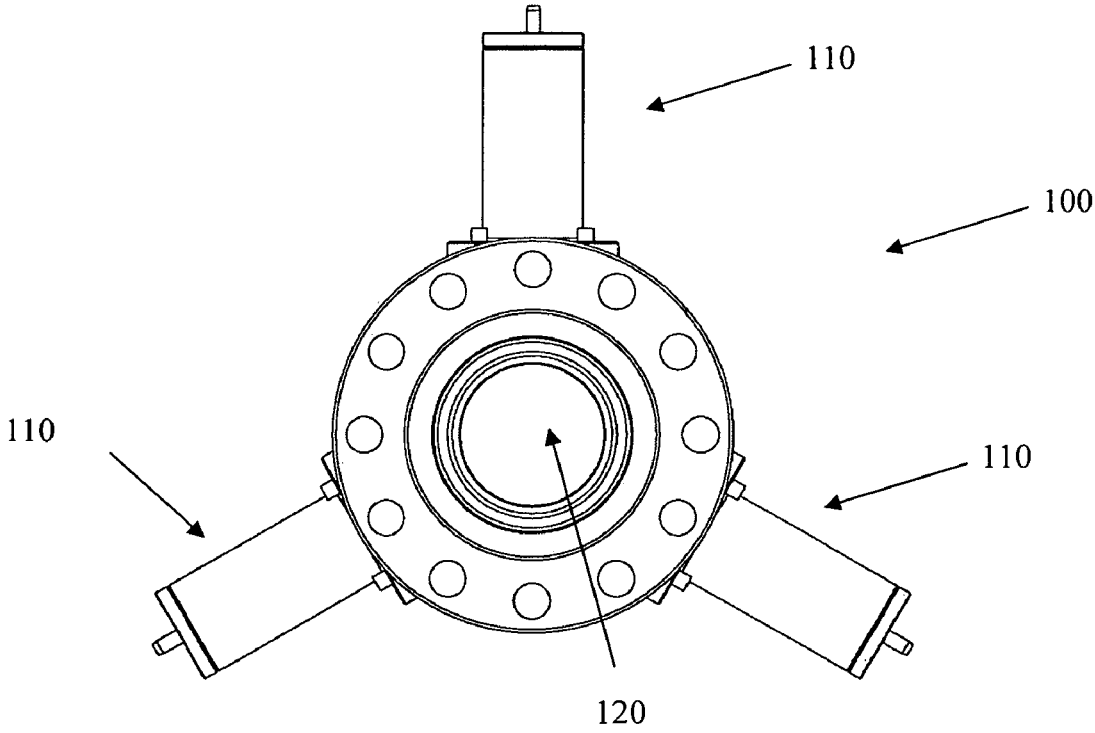
FIG. 4 is a top view of the hydraulic connector shown in FIG. 3.

FIG. 3 shows a perspective view of a hydraulic connector 100 that may be used to connect wellhead apparatus, such as a CT or wireline riser, to the BOP. The hydraulic connector 100 may include a central bore 120 as well as three hydraulic rams 110. Once connected, springs hold three segments inward preventing the union from being separated. The connection may be broken by applying hydraulic pressure to each ram 110 moving the segments to compress the springs releasing the hydraulic connector. The hydraulic connector 100 provides for the rapid connect and release of attachments to the BOP 10 in contrast to conventional threaded fittings. Additionally, the hydraulic connector 100 allows for such connections to be remotely operated. FIG. 4 is a top view of connector 100 and illustrates the central bore 120 as well as the spacing of the hydraulic rams 110. The hydraulic connector of FIGS. 3 and 4 may be a 5⅛ 10,000 PSI Quick Connect Union Assembly commercially offered by Vanoil Equipment Inc. of Leduc, Alberta, Canada. A number of commercially available hydraulic connectors may be used with the BOP as would be appreciated by one of ordinary skill in the art having the benefit of this disclosure.

FIG. 5 is the cross-sectional view of one embodiment of a dual purpose BOP 10 of the present disclosure. The BOP 10 includes blind/shear rams 20, locate rams 30, pipe rams 40, and pipe/slip rams 50. A tool may be pulled up to the shoulder 31 of the closed locate rams 30 in order to position the UCD axially in the BOP 10. The locate rams 30 may include a tapered funnel portion 32, which may be used to guide an upper UCD section 220 attached to a CT string with residual curvature together with a lower UCD section 230. FIG. 5 shows a lower UCD section 230 connected to a BHA 250 pulled up to the shoulder 31 of the locate rams 30, which positions the tool module in the wellhead. The pipe rams 40 include a sealing element 41 such that when the pipe rams 40 are closed on the lower UCD section 230 the sealing element 41 creates the upper seal of an annular chamber 81. Likewise, the pipe/slip rams 50 include a sealing element 51 such that when the pipe/slip rams 50 are closed on the BHA adjacent to the lower UCD section 230 the sealing element 51 creates the lower seal of the annular chamber 81. The pipe/slip rams 50 also include a slip 52 that supports the weight of the tool as well as pressure induced forces on the tool.

As discussed above, the shoulder 31 of the locate rams 30 locates the lower UCD section 230 and the BHA 250 in the wellhead. The lower UCD section 230 includes an external port 241. When the lower UCD section 230 is positioned in the wellhead, its external port 241 is positioned within the annular chamber 81 between the pipe rams 40 and the pipe/slip rams 50. The annular chamber 81 may then be pressurized through a port in the BOP 10, into the lower UCD section's port 241, to release a latching mechanism 240. An upper UCD section 220, which may be connected to a tool module or CT string may then be introduced into the BOP 10 and inserted into the lower UCD section 230. The depressurizing of the annular chamber 81 through the port causes the latching mechanism 240 to secure together the upper UCD section 220 and the lower UCD section 230. The annular chamber 81 created by the pipe rams 40 and pipe/slip rams 50 may also be used to break down a BHA 250 into tool modules for removal from the BOP 10.

Figure 6:
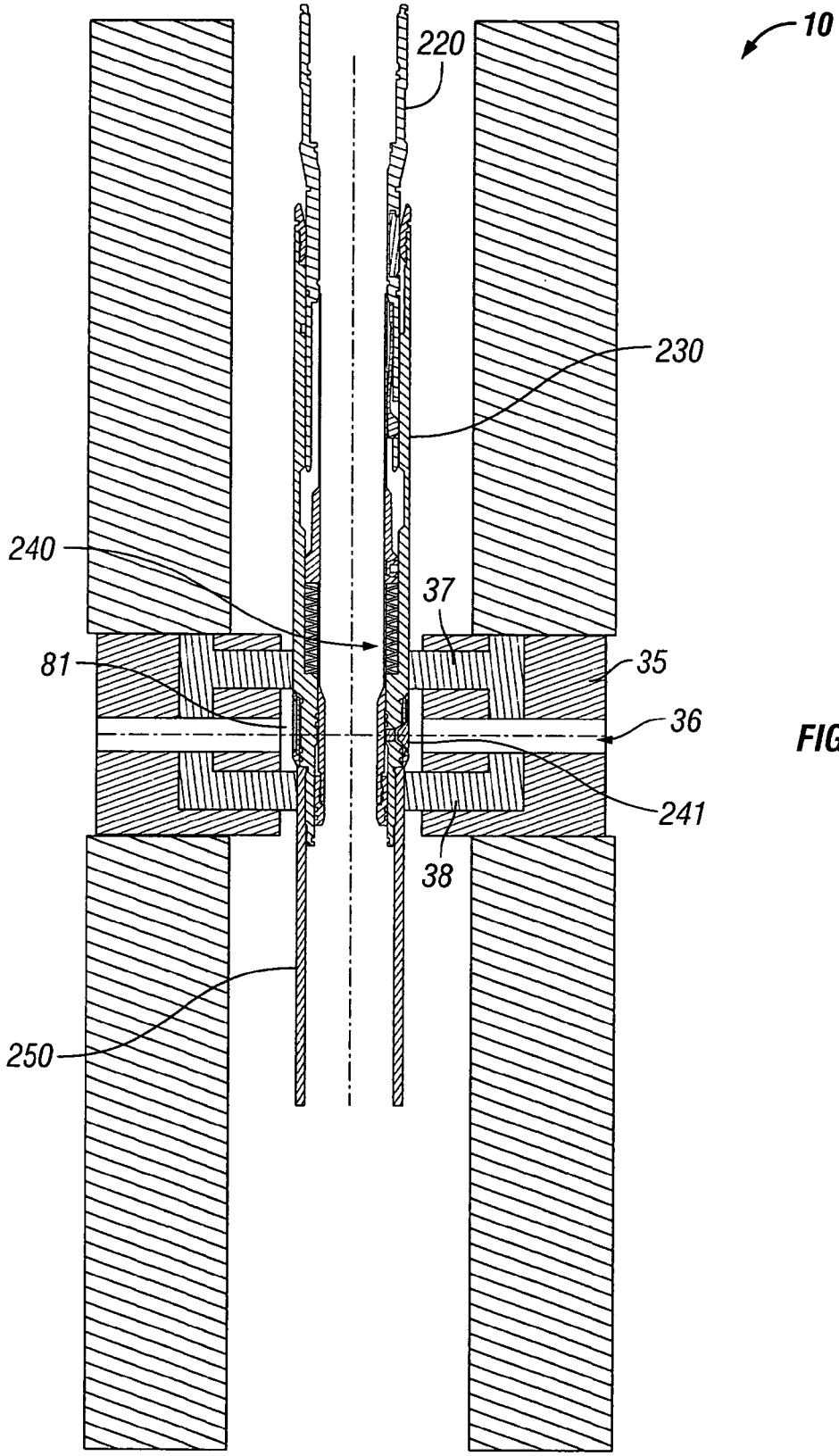
FIG. 6 is the cross-section of one embodiment of the present disclosure of a ram having two sealing elements to create an annular chamber around a coiled tubing connector.

FIG. 6 shows the cross-section of a portion of a BOP 10 that includes set of rams 35 that include an upper sealing element 37 and a lower sealing element 38. An annular chamber 81 is created when the rams 35 close on a lower UCD section 230 of a BHA 250. The lower UCD section 230 may be connected to an upper UCD section 220, which may be connected to a tool module or CT string. The annular chamber 81 may then be pressurized through a fluid passageway 36 through the ram 35, into the lower UCD section's port 241, to release a latching mechanism 240. The depressurizing of the annular chamber 81 through the port causes the latching mechanism 240 to secure together the upper UCD section 220 and the lower UCD section 230 as discussed above and disclosed in the '652 patent.

Figure 7:
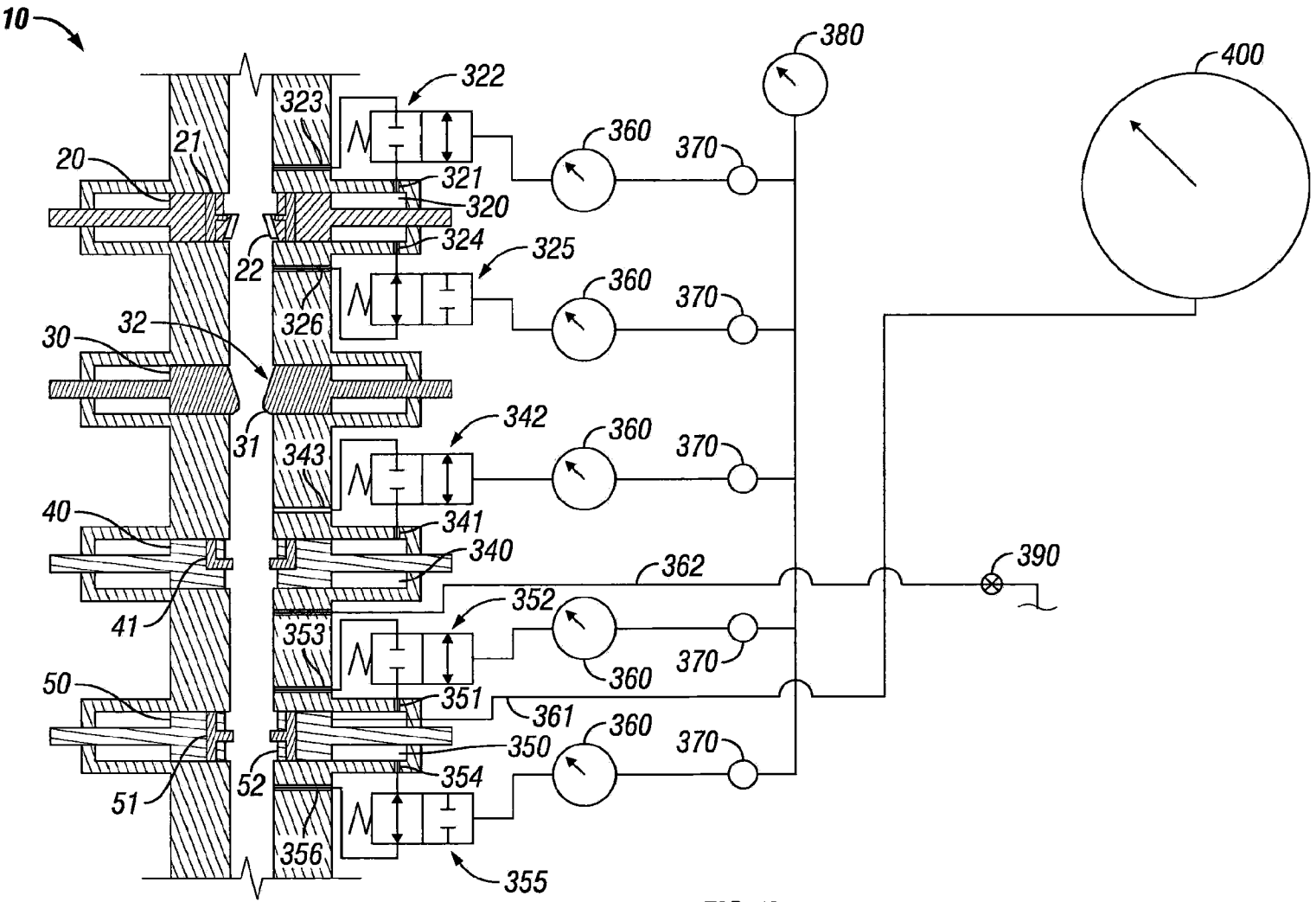
FIG. 7 is a schematic of one embodiment of a BOP that uses two-way equalization valves to equalize pressure above and below the rams.

FIG. 7 shows a schematic depicting one embodiment of a BOP 10 that uses two-way equalization in combination with fluid passageway located above and below various rams of the BOP 10. The dual purpose BOP 10 of FIG. 7 includes blind/shear rams 20, locate rams 30, pipe/rams 40, and pipe/slip rams 50.

The blind/shear rams 20 include a sealing element 21 that may bi-directionally seal against pressure. A portion 22 of the blind/shear rams 20 may be adapted to cut through a CT string if needed to contain the wellhead pressure. The BOP includes a passageway 323 located above the set of blind/shear rams 20, the passageway 323 being in fluid communication with a two-way valve 322. In the deployment mode, the valve 322 is used to selectively allow pressure from above the blind/shear rams 20 into a chamber 320 located behind the blind/shear rams 20 through passageway 321. The pressure within this chamber 320 assists the hydraulics of the BOP 10 to maintain the blind/shear rams 20 in the actuated position sealing off against the pressure from above the blind/shear rams 20. The valve 322 is configured to default to a closed positioned, which prevents pressure from entering into the chamber 320. Hydraulic pressure is applied from a source 380, such as a pump, to open the valve and allow pressure to enter into the chamber 320.

The BOP 10 includes means 370 to remotely actuate the two-way valves. Each of the hydraulic lines used to actuate the two-way valves may further include a gauge 360 that may be used to determine the activation pressure on each valve.

The BOP 10 includes a passageway 326 located below the blind/shear rams 20 that is in communication with a two-way valve 325. In the pressure containment mode, the valve is used to selectively allow pressure from below the blind/shear rams 20 into the chamber 320 located behind the blind/shear rams 20 through passageway 324. The pressure within this chamber 320 assists the hydraulics of the BOP 10 to maintain the blind/shear rams 20 in the actuated position sealing off against the pressure from below the blind/shear rams 20. The valve 325 is configured to default to an open position, which allows pressure into the chamber 320. Hydraulic pressure is applied from a source 380 to close the valve 325. In the event the valve 325 fails, it is configured to failsafe allowing pressure from below the blind/shear rams 20 into the chamber 320 such that the downhole pressure is contained by the blind/shear rams 20.

The BOP includes a passageway 353 located above the set of pipe/slip rams 50, the passageway 353 in communication with a two-way valve 352. In the deployment mode, the valve 352 is used to selectively allow pressure from above the pipe/slip rams 50 into a chamber 350 located behind the pipe/slip rams 50 through passageway 351. The pressure within this chamber 350 assists the hydraulics of the BOP 10 to maintain the pipe/slip rams 50 in the actuated portion sealing off against the pressure from above the pipe/slip rams 50. The valve 352 is configured to default to a closed position, which prevents pressure from entering into the chamber 350. Hydraulic pressure is applied from a source 380 to open the valve allow pressure into the chamber 350.

The BOP 10 includes a passageway 356 located below the pipe/slip rams 50 that is in communication with a two-way valve 355. In the pressure containment mode, the valve 355 is used to selectively allow pressure from below the pipe/slip rams 50 into the chamber 350 located behind the pipe/slip rams 50 through passageway 354. The pressure within this chamber 350 assist the hydraulics of the BOP 10 to maintain the pipe/slip rams 50 in the actuated position sealing off against the pressure from below the pipe/slip rams 20. The valve 355 is configured to default to an open position, which allows pressure into the chamber 350. Hydraulic pressure is applied from a source 380 to close the valve 355. In the event the valve 355 fails, it is configured to failsafe allowing pressure from below the pipe/slip rams 50 into the chamber 350 such that the downhole pressure is contained by the pipe/slip rams 50.

The BOP 10 includes passageway 343 located above the pipe rams 40, the passageway 343 being in communication with a two-way valve 342. The valve 342 may be used to selectively equalize the pressure in the chamber 340 behind the actuated pipe rams 40 through passageway 341 with the pressure present in the BOP 10 above the pipe rams. During the deployment mode the pipe rams 40 are closed on a BHA and the annular chamber between the pipe rams 40 and the pipe/slip rams 50 is pressurized. This pressure will also be present in chamber 340 because the sealing element 41 of the pipe rams 40 only seals off the upper portion of the pipe rams 40. Opening valve 342 allows the pressure within the chamber 340 as well as the annular chamber between the rams to be equalized with the BOP 10 pressure. The valve 342 is configured to default to a closed position preventing the equalization of pressure between the chamber 340 and the BOP 10. Hydraulic pressure may be applied from a source 380 to open the valve 342.

The BOP 10 includes a hydraulic line 361 in communication with a hydraulic pressure source 400 that is used to pressurize the annular chamber that may be formed with the actuation of the pipe rams 40 and the pipe/slip rams 50. The pressure may be dumped through a second hydraulic line 362 connected to a pressure dump 390.

Figure 8:
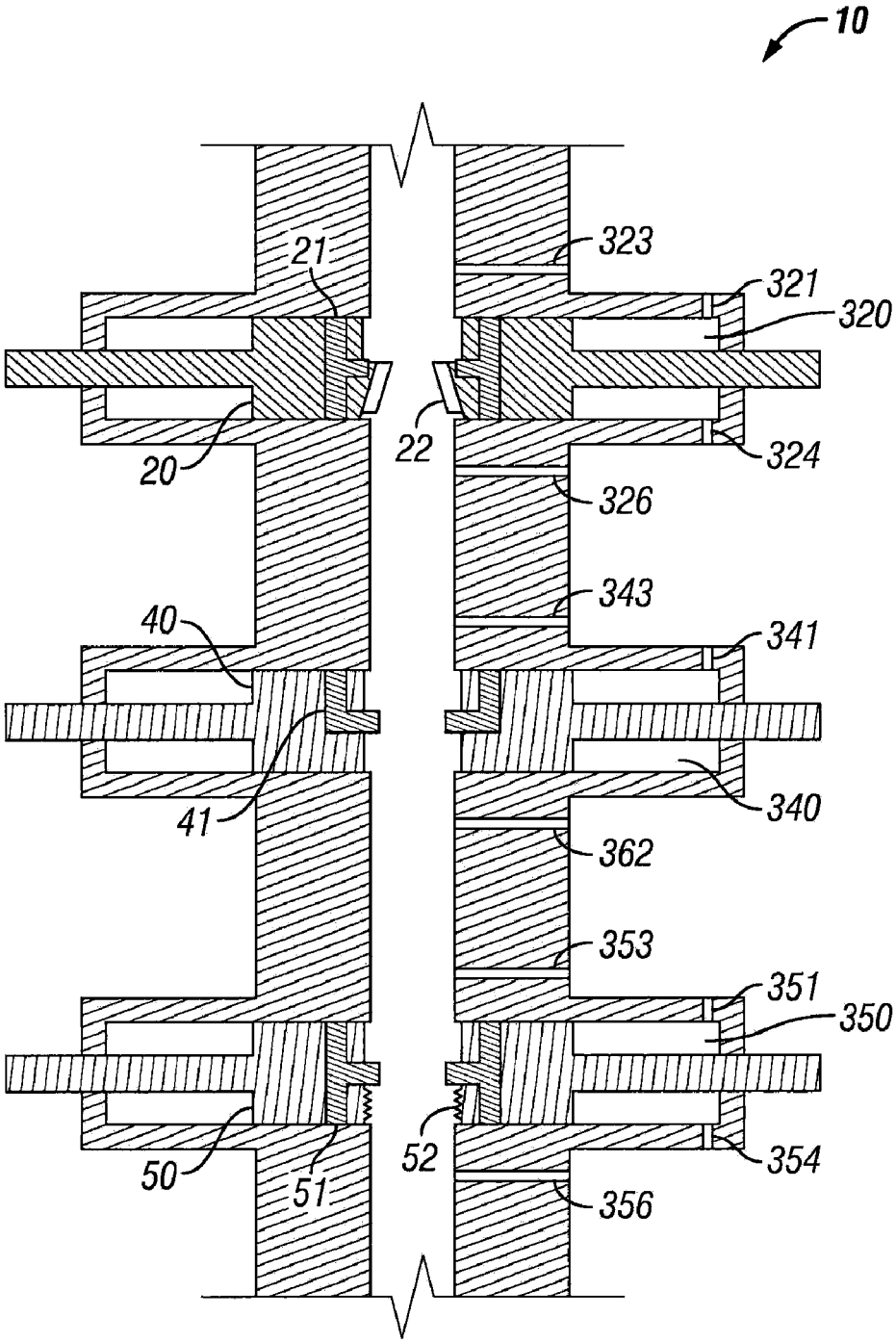
FIG. 8 is the cross-section of one embodiment of the present disclosure of a BOP having a set of blind/shear rams, a set of pipe rams, and a set of pipe/slip rams.

FIG. 8 shows the cross-section of one embodiment of a BOP 10 that includes three sets of rams. The BOP 10 includes a set of blind/shear rams 20, a set of pipe rams 40, and a set of pipe/slip rams 50. The BOP 10 and rams include various features that have been previously discussed herein. For example, the pipe/slip rams 50 include a sealing element 51 and a slip 52, which may be used to support a BHA. A BHA may be run into a the BOP 10 and pulled up to an apparatus connected to the top of the BOP 10 to locate a connector within the BOP between the pipe rams 20 and the pipe/slip rams 50. For example, the top portion of a BHA may be pulled up to a stuffing box on a CT lubricator or a grease injection pack-off on a wire-line riser, which are sized to prevent the BHA from passing. The BHA may then be sized to locate a connector between the pipe rams 20 and the pipe/slip rams 50. Alternatively, the BHA may be moved down a designated distance from the stuffing box or the grease injection pack-off to properly locate the connector.

The pipe rams 40 and the pipe/slip rams 50 may then be closed to create an annular chamber around the connector. The annular chamber may then be pressurized through a hydraulic line to secure or disengage a connector as previously disclosed herein.

Figure 9:
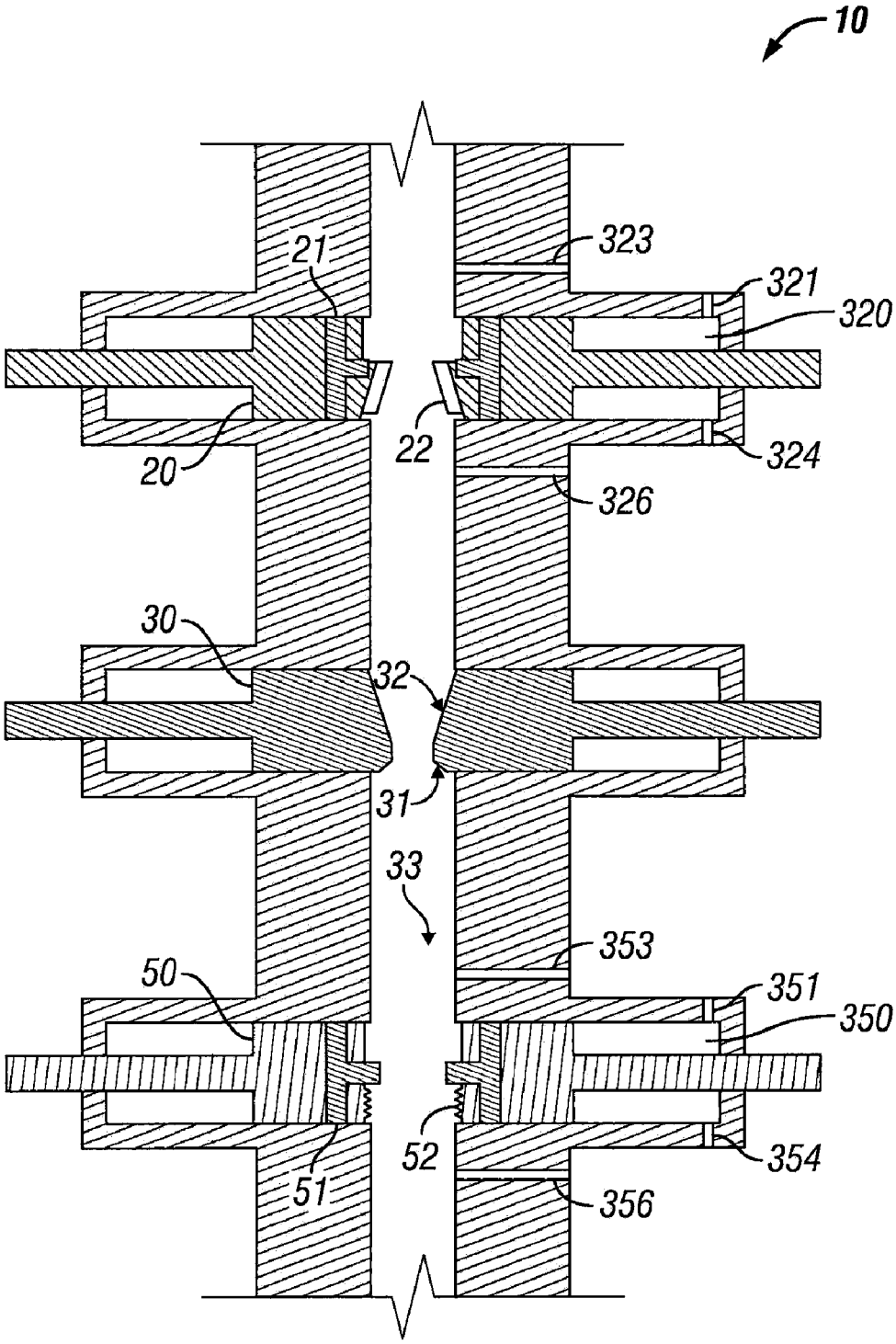
FIG. 9 is the cross-section of one embodiment of the present disclosure of a BOP having a set of blind/shear rams, a set of locator rams, and a set of pipe/slip rams.
Figure 10:
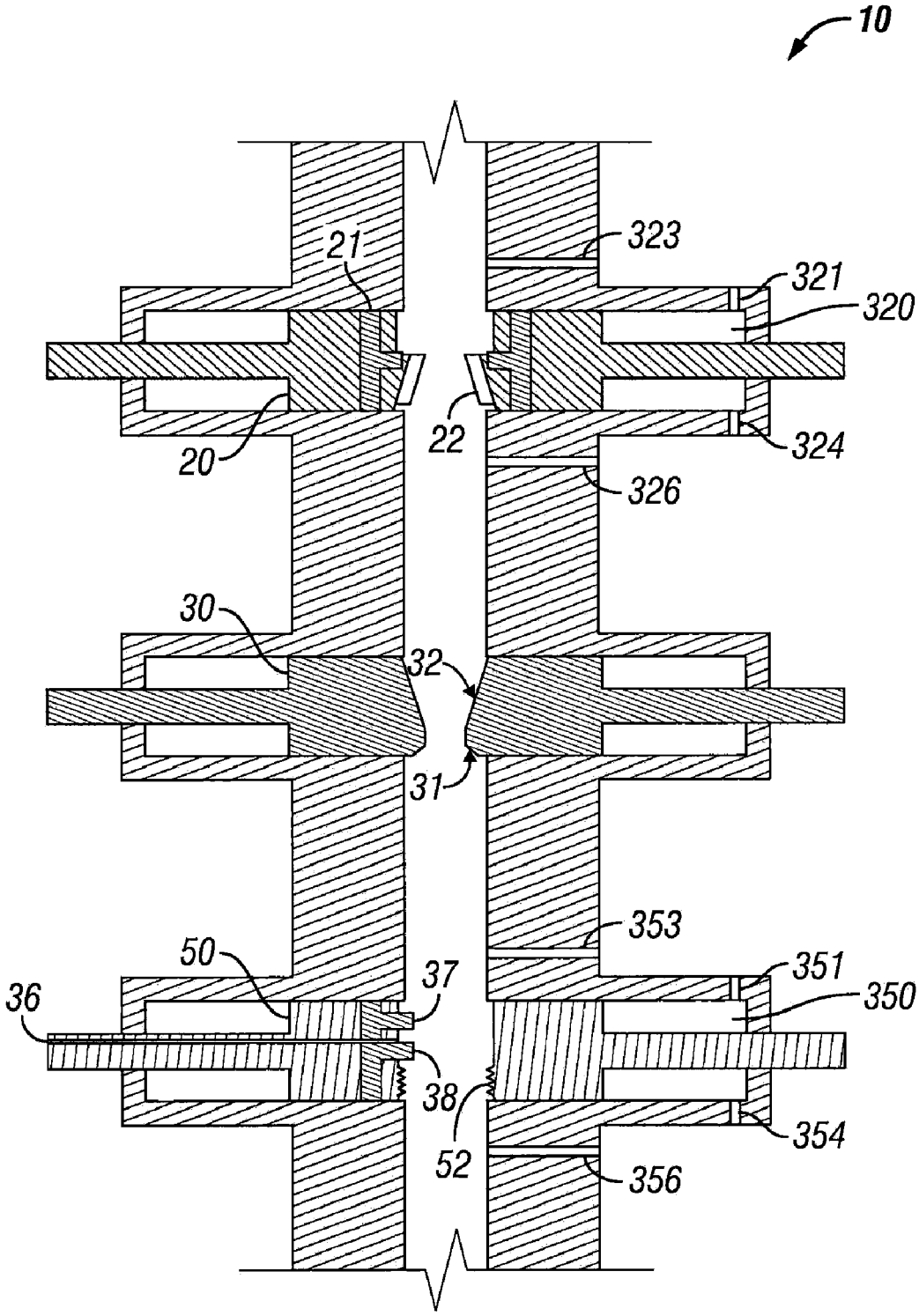
FIG. 10 is the cross-section of one embodiment of the present disclosure of a BOP having a set of blind/shear rams, a set of locator rams, and a set of pipe/slip rams that include an upper sealing element, a lower sealing element, and a fluid passageway to pressurize a chamber created between the upper sealing element and the lower sealing element when the pipe/slip rams are closed on a connector.

FIG. 9 shows the cross-section of one embodiment of a BOP 10 that includes three sets of rams. The BOP 10 includes a set of blind/shear rams 20, a set of locate rams 30, and a set of pipe/slip rams 50. The BOP 10 and rams include various features that have been previously discussed herein. For example, the locate rams 30 include a tapered funnel portion 32 which may be used to guide the connector together in spite of the residual curvature of the CT string. A lower shoulder 31 and a restricted bore 33 may be used to properly position a tool module within the BOP. The blind/shear rams 20 and the pipe/slip rams 50 may then be closed to create a large annular chamber around the BHA. The large annular chamber may then be pressurized through a hydraulic line to secure or disengage a connector as previously disclosed herein.

FIG. 10 shows the cross-section of one embodiment of a BOP 10 that includes three sets of rams. The BOP 10 includes a set of blind/shear rams 20, a set of locate rams 30, and a set of pipe/slip rams 50. The BOP 10 and rams include various features that have been previously discussed herein. For example, the pipe/slip rams 30 include an upper sealing element 37 and a lower sealing element 38. An annular chamber is created when the pipe/slip rams 50 are closed on a connector. The annular chamber may then be pressurized through a fluid passageway 36 through the pipe/slip rams 50 to secure or disengage a connector as previously disclosed herein.

Although various embodiments have been shown and described, the invention is not so limited and will be understood to include all such modifications and variations as would be apparent to one skilled in the art.

What is claimed is:

1. A deployment and pressure containment blow out preventer, the blow out preventer comprising:

a longitudinal bore;

a set of blind shear rams in communication with the bore, the blind shear rams having a closed position and an open position, wherein in the closed position the blind shear rams create a first barrier to wellbore pressure;

a set of locate rams in communication with the bore and located beneath the blind shear rams, the set of locate rams having a closed position and an open position, wherein in the closed position the locate rams include an opening adapted to prevent a portion of a coiled tubing connector from passing the locate rams;

a set of pipe rams in communication with the bore and located beneath the locate rams, the set of pipe rams having a closed position and an open position, wherein in the closed position the pipe rams are adapted to seal on a portion of a coiled tubing connector, the coiled tubing connector being connected to a bottom hole assembly;

a set of pipe slip rams in communication with the bore and located beneath the pipe rams, the pipe slip rams having a closed position and an open position, wherein when in the closed position the pipe slip rams are adapted to seal on a portion of the bottom hole assembly forming an annular chamber and creating a second barrier to wellbore pressure; and a valve in communication with the annular chamber formed between the pipe rams in the closed position and the pipe slip rams in the closed position.

2. The blow out preventer of claim 1 wherein the set of pipe slip rams are adapted to seal on a portion of the bottom hole assembly having an outer diameter substantially identical to the outer diameter of coiled tubing.

3. The blow out preventer of claim 1 further comprising a first passageway located above the blind shear rams, the first passageway in communication with the longitudinal bore and a first two-way valve, wherein the first valve selectively allows pressure from above the blind shear rams into a chamber behind the blind shear rams.

4. The blow out preventer of claim 3 further comprising a second passageway located below the blind shear rams, the second passageway in communication with the longitudinal bore and a second two-way valve, wherein the second valve selectively allows pressure from below the blind shear rams into the chamber behind the blind shear rams.

5. The blow out preventer of claim 4 wherein the first two-way valve is biased to prevent pressure into the chamber behind the blind shear rams.

6. The blow out preventer of claim 5 wherein the second two-way valve is biased to allow pressure into the chamber behind the blind shear rams.

7. The blow out preventer of claim 4 further comprising a third passageway located above the pipe slip rams, the third passageway in communication with the longitudinal bore and a third two-way valve, wherein the third valve selectively allows pressure from above the pipe slip rams into the chamber behind the pipe slip rams.

8. The blow out preventer of claim 7 further comprising a fourth passageway located below the pipe slip rams, the fourth passageway in communication with the longitudinal bore and a fourth two-way valve, wherein the fourth valve selectively allows pressure from below the pipe slip rams into the chamber behind the pipe slip rams.

9. The blow out preventer of claim 8 wherein the third two-way valve is biased to prevent pressure into the chamber behind the pipe slip rams.

10. The blow out preventer of claim 9 wherein the fourth two-way valve is biased to allow pressure into the chamber behind the pipe slip rams.

11. The blow out preventer of claim 8 further comprising a fifth passageway located above the pipe rams, the fifth passageway in communication with the longitudinal bore and a fifth two-way valve, wherein the fifth valve selectively allows pressure within a chamber behind the pipe rams to equalize with pressure within the longitudinal bore.

12. The blow out preventer of claim 11 wherein the fifth two-way valve is biased to prevent the equalization of pressure in the chamber behind the pipe rams with the pressure within the longitudinal bore.

13. The blow out preventer of claim 11 wherein the first two-way valve, the second two-way valve, the third two-way valve, the fourth two-way valve, or the fifth two-way valve may be remotely actuated.

14. The blow out preventer of claim 1 wherein the locate rams further comprise a funnel shaped guide to align and centralize a coiled tubing connector.

15. The blow out preventer of claim 1 wherein the valve is a two-way valve that may be remotely actuated.

16. The blow out preventer of claim 15 wherein the annular chamber may be pressurized through the valve to actuate a coiled tubing connector.

17. A method for deploying a coiled tubing tool into a dual purpose blow out preventer, the method comprising:

inserting a first coiled tubing tool module into a longitudinal bore of the dual purpose blow out preventer, the first coiled tubing tool module having a first connector positioned at the upper end of the tool module and the blow-out preventer including a set of blind shear rams, a set of locate rams, a set of pipe rams, and set of pipe slip rams;

moving the first coiled tubing tool module past the locate rams;

closing the locate rams, the closed locate rams having an opening adapted to be larger than an upper portion of the first connector;

pulling the first coiled tubing tool module up to the closed locate rams until a lower portion of the first connector is adjacent to the opening, wherein the opening is adapted to prevent the lower portion of the first connector from passing through the opening;

closing the set of pipe rams on the first coiled tubing tool module;

closing the set of pipe slip rams on the first coiled tubing tool module to create an annular chamber between the closed pipe rams and the closed pipe slip rams; and pumping fluid through a two way valve into the annular chamber to pressurize the annular chamber.

18. The method of claim 17 wherein pumping fluid into the annular chamber causes the release of a locking mechanism of the first connector.

19. The method of claim 18 further comprising inserting a second coiled tubing tool module into the dual purpose blow out preventer until a second connector located on the lower end of the second coiled tubing tool module engages the first connector of the first coiled tubing tool module.

20. The method of claim 19 further comprising releasing the pressure in the annular chamber, wherein the release of pressure locks the first connector with the second connector.

21. The method of claim 20 further comprising pumping fluid through the two way valve into the annular chamber to pressurize the annular chamber.

22. The method of claim 21 further comprising disconnecting the second connector from the first connector and removing the second coiled tubing module from the dual purpose blow out preventer.

23. The method of claim 17 further comprising equalizing the pressure within the dual purpose blow out preventer through a valve located between the set of blind shear rams and the set of locate rams.

24. The method of claim 17 further comprising pressure testing an apparatus connected to the above the dual purpose blow out preventer through a valve located above the set of blind shear rams.

25. The method of claim 17 further comprising allowing pressure from above the blind shear rams into a chamber behind the blind shear rams and preventing pressure from below the blind shear rams from entering into the chamber behind the blind shear rams.

26. The method of claim 17 further comprising allowing pressure from above the pipe slip rams into a chamber behind the pipe slip rams and preventing pressure from below the pipe slip rams from entering into the chamber behind the pipe slip rams.

27. The method of claim 17 further comprising equalizing the pressure below the closed pipe rams with the pressure in the longitudinal bore above the pipe rams.

* * * * *